US009472048B1

(12) United States Patent
Wiese

(10) Patent No.: US 9,472,048 B1
(45) Date of Patent: Oct. 18, 2016

(54) CABINET TOP FOR GAMING MACHINES

(71) Applicant: Michael J. Wiese, Desmet, SD (US)

(72) Inventor: Michael J. Wiese, Desmet, SD (US)

( * ) Notice: Subject to any disclaimer, the term of this patent is extended or adjusted under 35 U.S.C. 154(b) by 8 days.

(21) Appl. No.: 14/493,574

(22) Filed: Sep. 23, 2014

Related U.S. Application Data

(60) Provisional application No. 61/881,245, filed on Sep. 23, 2013.

(51) Int. Cl.
*G07F 17/32* (2006.01)

(52) U.S. Cl.
CPC ..... *G07F 17/3216* (2013.01); *G07F 17/32* (2013.01)

(58) Field of Classification Search
CPC ..... A63F 1/067; G07F 17/32; G07F 17/3216
USPC ..... 273/309; 463/46; 312/140.3; 108/27; 248/220.21, 220.22, 225.11, 225.21, 248/298.1, 551, 678
See application file for complete search history.

(56) References Cited

U.S. PATENT DOCUMENTS 2,980,477 A * 4/1961 Hansen ..... A47B 77/022 108/27
3,493,201 A * 2/1970 Marran ..... F16M 7/00 248/346.03
3,791,613 A * 2/1974 Nollen ..... H02G 3/0456 174/68.3
4,421,365 A * 12/1983 Taniwaki ..... A47B 53/02 104/287
5,692,722 A * 12/1997 Lundagårds ..... E05B 73/0082 248/224.61
5,826,882 A * 10/1998 Ward ..... G07F 9/10 273/143 R
D472,939 S * 4/2003 Philpott ..... D21/369
6,880,825 B2 * 4/2005 Seelig ..... G07F 17/3216 273/143 R
7,108,237 B2 * 9/2006 Gauselmann ..... G07F 9/10 248/220.22
8,012,028 B1 * 9/2011 McNamara ..... G07F 17/3216 248/676
9,275,511 B2 3/2016 Vollmann
2007/0057607 A1 * 3/2007 Caissie ..... A47B 91/005 312/265.6
2009/0280911 A1 * 11/2009 Tsao ..... G07F 17/32 463/46
2011/0315850 A1 * 12/2011 Kubach ..... G07F 17/3216 248/678
2012/0058830 A1 * 3/2012 Vollmann ..... G07F 17/3216 463/47
2014/0206457 A1 * 7/2014 Eustaquio ..... A47B 96/06 463/46
2015/0213678 A1 * 7/2015 Vollmann ..... G07F 17/3216 463/46

* cited by examiner

*Primary Examiner* — Jonathan Liu
*Assistant Examiner* — Guang H Guan
(74) *Attorney, Agent, or Firm* — Jeffrey A. Proehl; Woods, Fuller, Shultz & Smith, P.C.

(57) ABSTRACT

A cabinet top assembly may comprise a top plate having upper and lower surfaces and at least one mounting aperture therethrough, and a mounting fixture for mounting a gaming machine to the top plate. The mounting fixture may comprise a first mounting rail positioned below the top plate adjacent to the mounting aperture, an intermediate rail positioned below the top plate adjacent to the mounting aperture, and at least one mount member extendable between the first mounting rail and the intermediate member in a position adjacent to the mounting aperture. The at least one mount member may have a mount end configured to mount on the mounting rail in a manner resisting removal of the mount end from the mounting rail while permitting sliding of the mount member along the mounting rail, and a free end being freely abuttable against the intermediate rail.

18 Claims, 9 Drawing Sheets

CABINET TOP FOR GAMING MACHINES

REFERENCE TO RELATED APPLICATIONS

This application claims the benefit of U.S. Provisional Patent Application No. 61/881,245 filed Sep. 23, 2013, which is hereby incorporated by reference in its entirety.

BACKGROUND

1. Field

The present disclosure relates to cabinets and more particularly pertains to a new cabinet top for gaming machines for mounting the machine to a supporting cabinet in a highly configurable manner.

2. Summary

In general, the present disclosure relates to a cabinet top assembly that includes a top plate and a mounting fixture associated with the tope plate for mounting a machine onto the cabinet top.

In one aspect, the disclosure relates to a cabinet top assembly for supporting a gaming machine on a support cabinet. The assembly may comprise a top plate for resting the gaming machine thereon, and the top plate may have an upper surface, a lower surface, a front and a rear. The top plate may have at least one mounting aperture therethrough. The assembly may also comprise a mounting fixture for mounting the gaming machine to the top plate, with the mounting fixture being mounted on the top plate adjacent the lower surface. The mounting fixture may comprise a first mounting rail positioned below the top plate and extending adjacent to the mounting aperture in the top plate, an intermediate rail positioned below the top plate and extending adjacent to the mounting aperture opposite of the first mounting rail, and at least one mount member extendable between the first mounting rail and the intermediate member in a position adjacent to the mounting aperture. The at least one mount member may have a mount end and a free end, with the mount end being configured to mount on the first mounting rail in a manner resisting removal of the mount end from the first mounting rail while permitting sliding of the mount member along the first mounting rail. The free end may be freely abuttable against the intermediate rail.

In another aspect, the disclosure relates to a cabinet top assembly for supporting a gaming machine on a support cabinet. The assembly may comprise a top plate for resting the gaming machine thereon, and the top plate may have an upper surface, a lower surface, a front and a rear. The top plate may have at least one mounting aperture therethrough. The assembly may also comprise a mounting fixture for mounting the gaming machine to the top plate, and the mounting fixture may be mounted on the top plate adjacent to the lower surface. The mounting fixture may comprise a first mounting rail positioned below the top plate and extending adjacent to the mounting aperture in the top plate, a second mounting rail positioned below the top plate and extending adjacent to the mounting aperture in the top plate, and an intermediate rail positioned below the top plate and extending adjacent to the mounting aperture with the intermediate rail being positioned between the first and second mounting rails. The mounting fixture may also include a plurality of mount members extendable between one of the mounting rails and the intermediate member in a position adjacent to the mounting aperture. The at least one mount member may have a mount end and a free end, with the mount end being configured to mount on one of the mounting rails in a manner resisting removal of the mount end from the mounting rail while permitting sliding of the mount member along the mounting rail. The free end may be freely abuttable against the intermediate rail.

In yet another aspect, the disclosure relates to a gaming system that may comprise a support cabinet, a cabinet top assembly mounted on a top of the support cabinet, and a gaming machine mounted on the cabinet top assembly. The cabinet top assembly may comprise a top plate with a lower surface and an upper surface on which the gaming machine is rested, with the top plate having at least one mounting aperture therethrough over which the gaming machine is positioned. The assembly may further include a mounting fixture mounting the gaming machine to the top plate with the mounting fixture being mounted on the top plate adjacent to the lower surface. The mounting fixture may comprise a first mounting rail positioned below the top plate and extending adjacent to the mounting aperture in the top plate, a second mounting rail positioned below the top plate and extending adjacent to the mounting aperture in the top plate, and an intermediate rail positioned below the top plate and extending adjacent to the mounting aperture, with the intermediate rail being positioned between the first and second mounting rails. The mounting fixture may also include a plurality of mount members extendable between one of the mounting rails and the intermediate member in a position adjacent to the mounting aperture. At least one of the mount members may have a fastener slot formed therein and a fastener passing through the fastener slot and engaging the gaming machine to attach the mount member to the machine. The at least one mount member has a mount end and a free end, with the mount end being configured to mount on one of the mounting rails in a manner resisting removal of the mount end from the mounting rail while permitting sliding of the mount member along the mounting rail. The free end may be freely abuttable against the intermediate rail.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

With reference now to the drawings, and in particular to FIGS. 1 through 9 thereof, a new cabinet top for gaming machines embodying the principles and concepts of the disclosed subject matter will be described.

Figure 1:
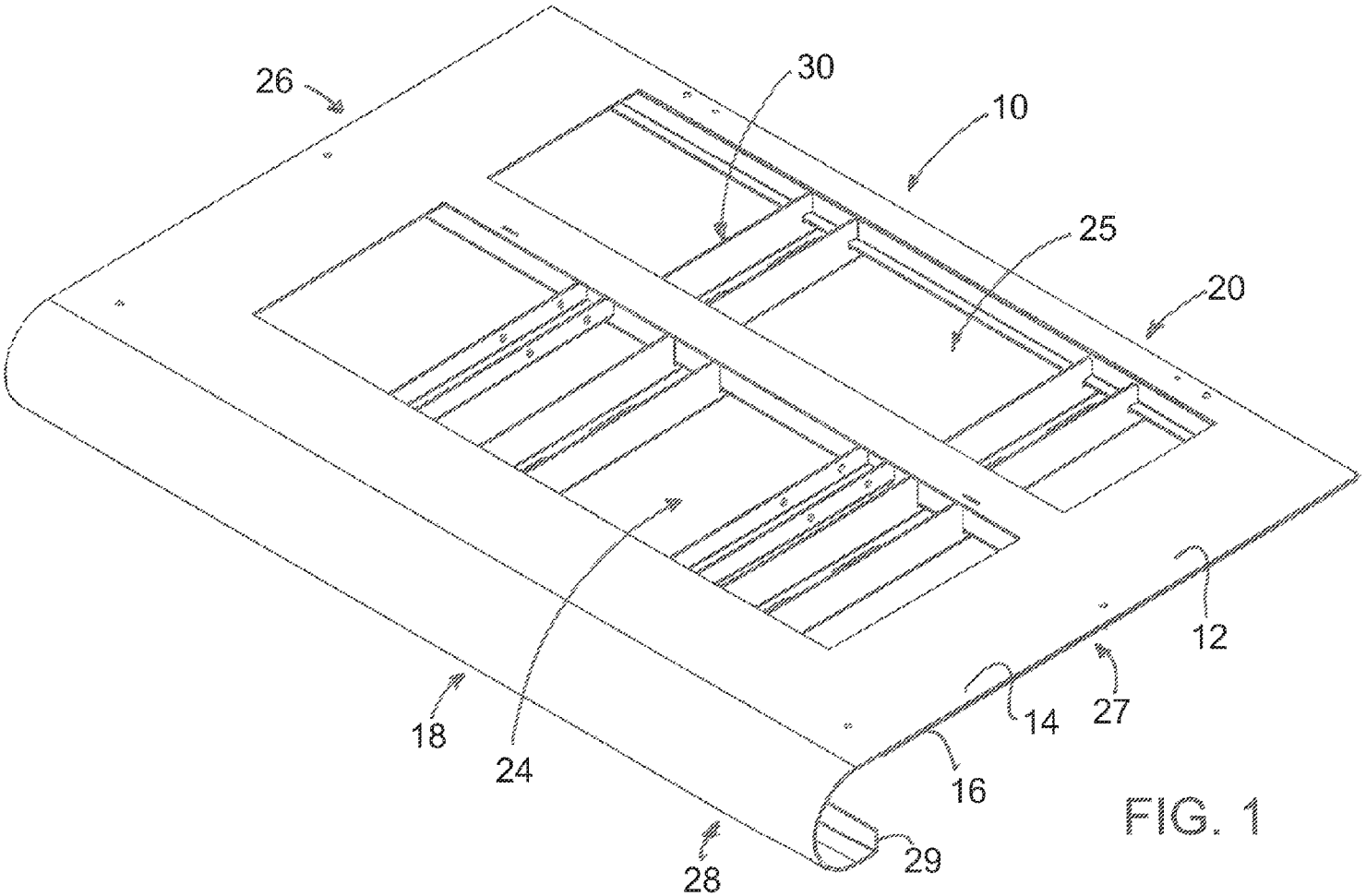
FIG. 1 is a schematic top perspective view of a new cabinet top for gaming machines according to the present disclosure.
Figure 2:
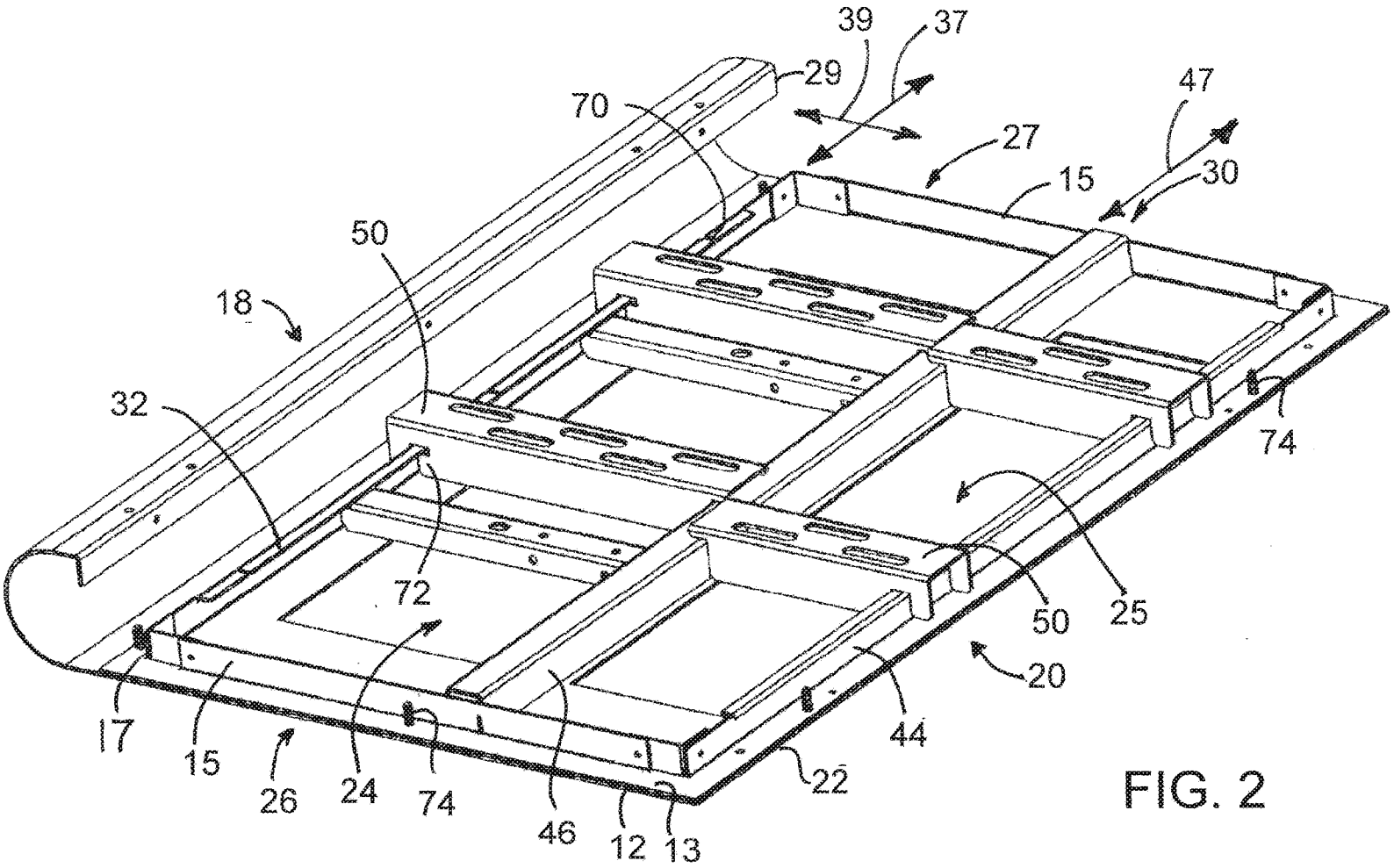
FIG. 2 is a schematic bottom perspective view of the cabinet top, according to an illustrative embodiment.
Figure 3:
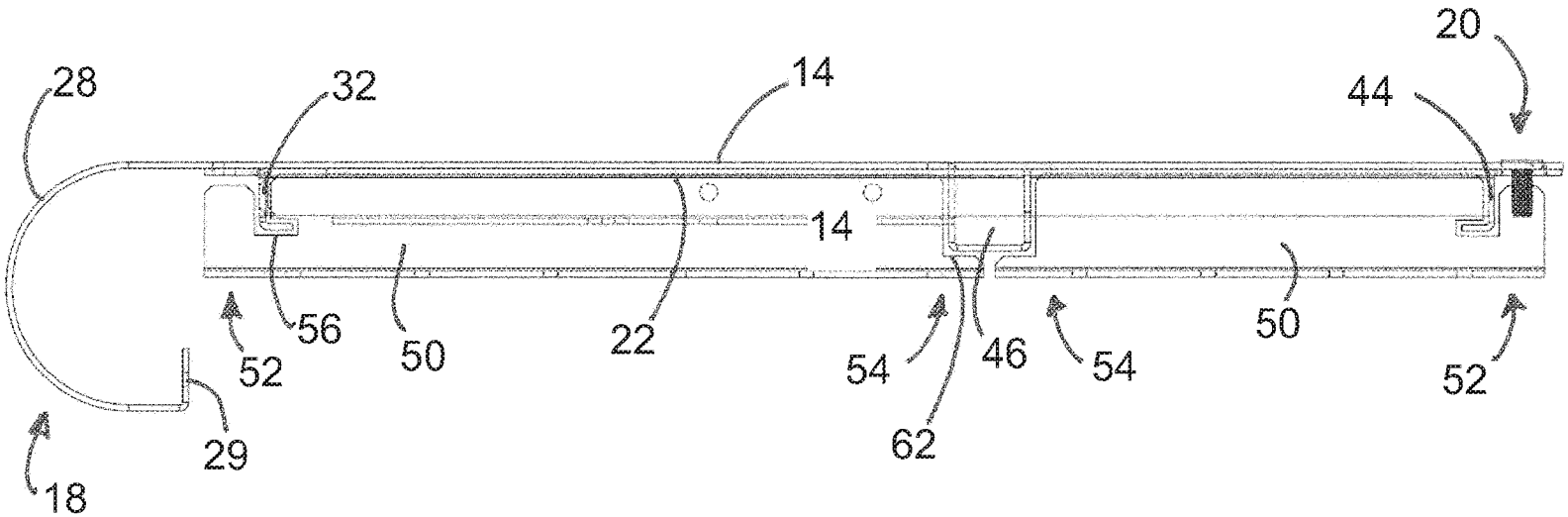
FIG. 3 is a schematic side view of the cabinet top, according to an illustrative embodiment.
Figure 4:
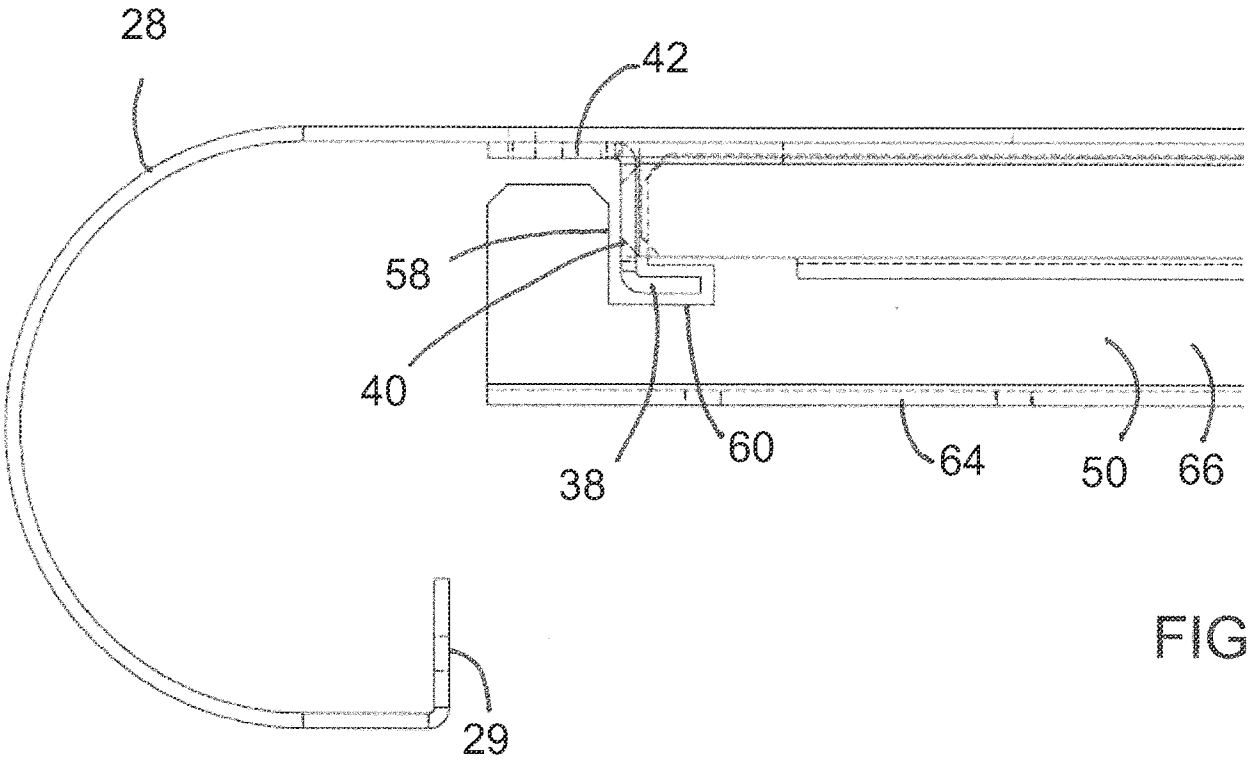
FIG. 4 is a schematic side view of a forward portion of the cabinet top, according to an illustrative embodiment.
Figure 5:
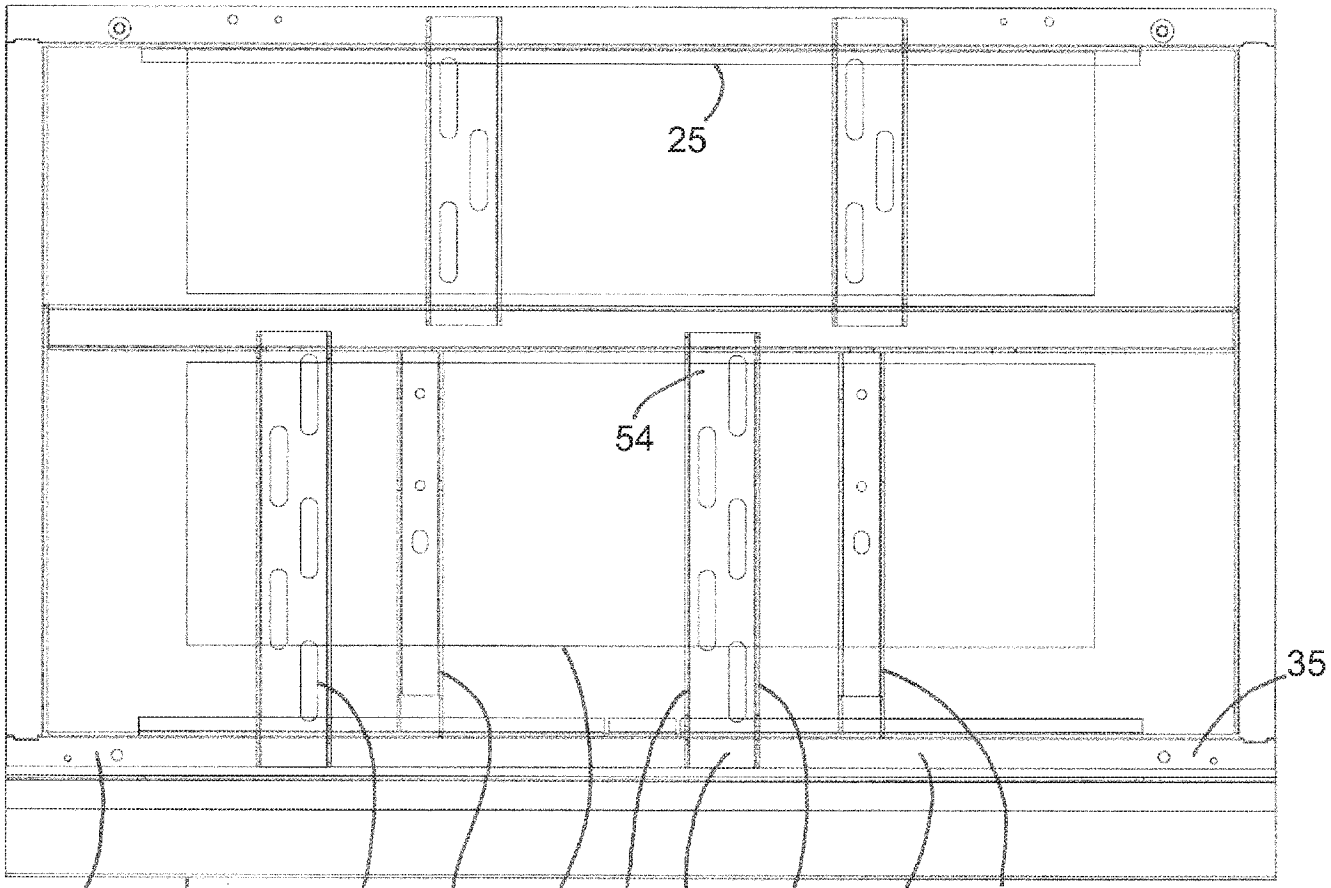
FIG. 5 is a schematic bottom view of the cabinet top, according to an illustrative embodiment.
Figure 6:
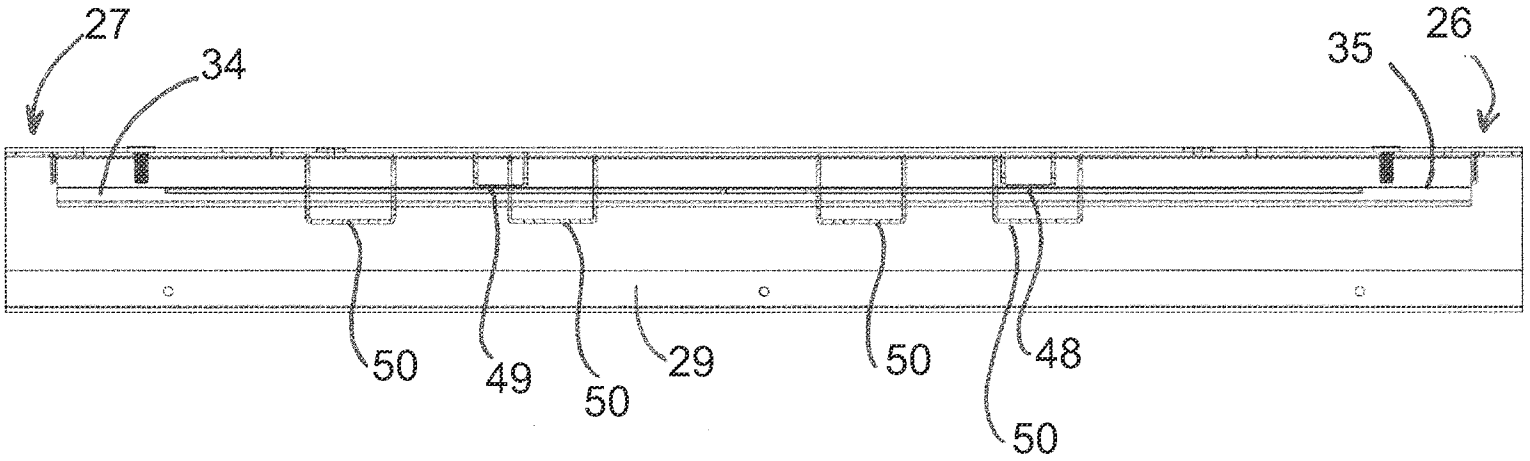
FIG. 6 is a schematic rear view of the cabinet top, according to an illustrative embodiment.
Figure 7:
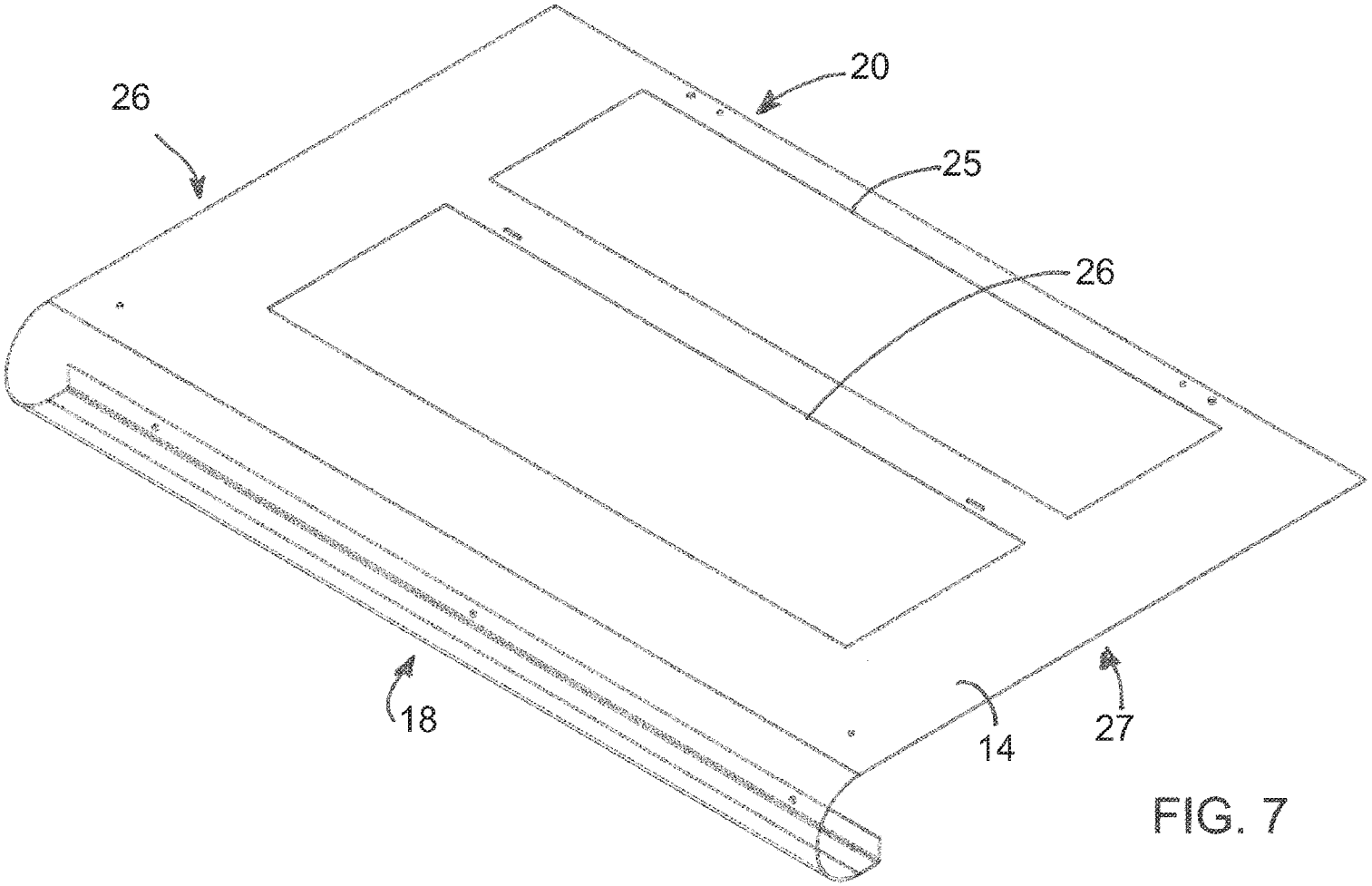
FIG. 7 is a schematic top perspective view of the top plate of the cabinet top, according to an illustrative embodiment.
Figure 8:
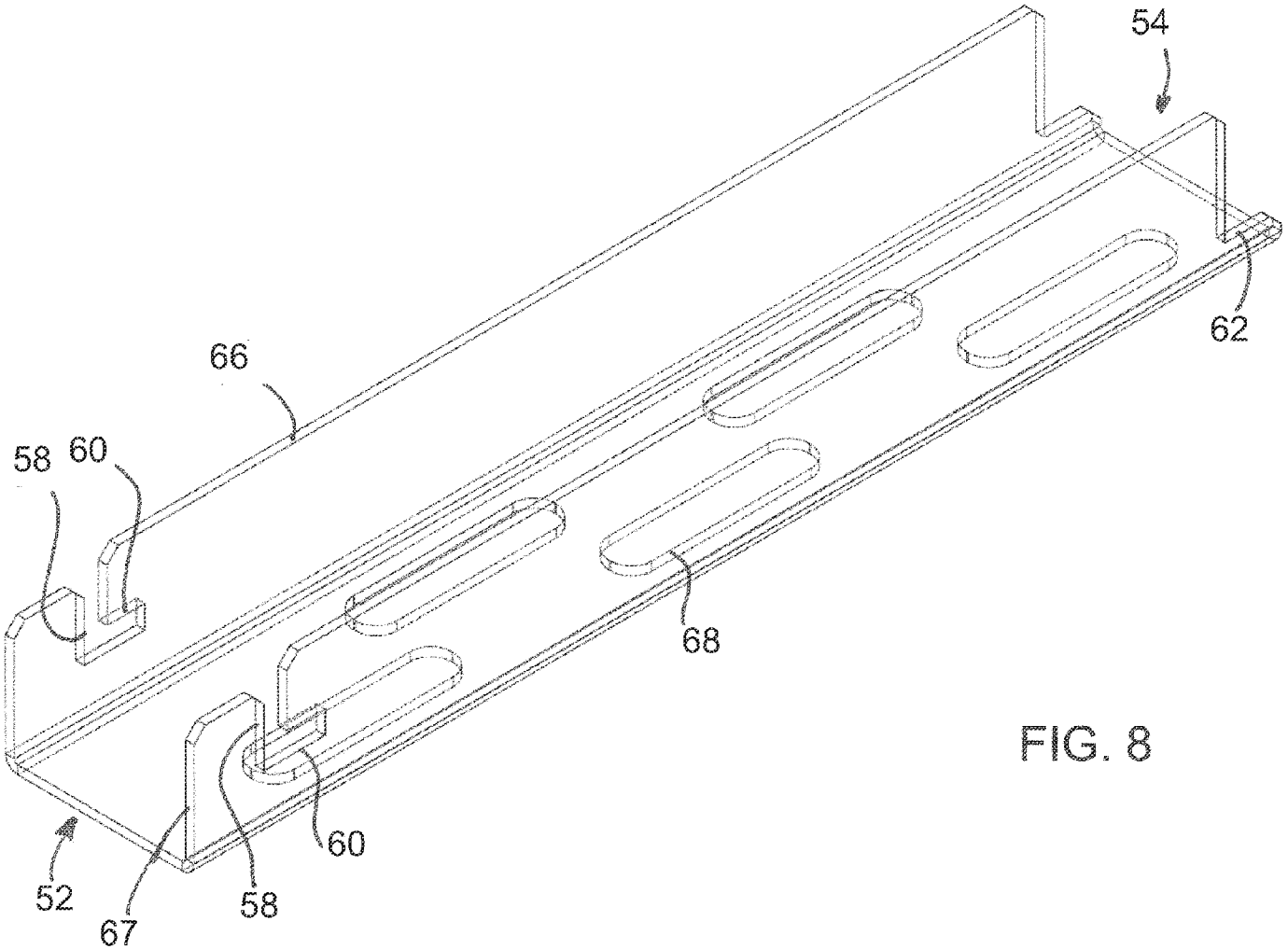
FIG. 8 is a schematic perspective view of a mount member shown in wire frame, according to an illustrative embodiment.
Figure 9:
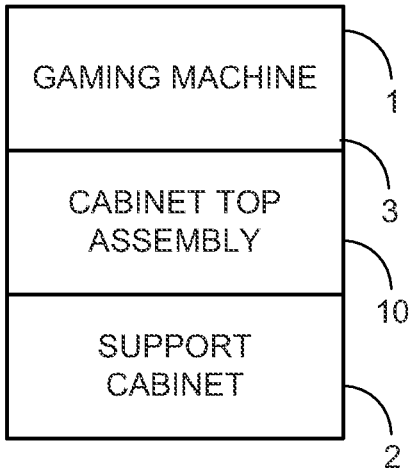
FIG. 9 is a schematic diagram of the cabinet top in relation to a gaming machine and a support cabinet, according to an illustrative embodiment.

The disclosure relates generally to a cabinet top assembly 10 for supporting a gaming machine 1 on a support cabinet 2 (see FIG. 9). The gaming machine 1 may have a bottom 3 with a plurality of mounting holes located thereon for receiving mounting fasteners that mount the machine to the cabinet top assembly. The cabinet top assembly 10 is highly configurable for connecting to various configurations of the locations of the mounting holes so that the mounting or attachment points on the cabinet top assembly are easily configurable to the locations of the mounting holes (or other mounting structures) on the machine 1.

In greater detail, the cabinet top assembly 10 may comprise a top plate 12 with an upper surface 14 on which the gaming machine may rest. The top plate has a perimeter edge 16, and a front 18 and a rear 20. The top plate may also have a lower surface 22 opposite of the upper surface. The top plate 12 may have at least one mounting aperture extending therethrough between the upper and lower surfaces, and may include a forward mounting aperture 24 located toward the front 18 and a rearward mounting aperture 25 located toward the rear 20. The top plate has sides 26, 27 that extend from the front to the rear. The top plate 12 may have a front portion 28 which may include a curvature about a laterally extending axis. The front portion may further include a forward lip 29 for positioning adjacent to a front of the support cabinet 2, and the forward lip may be substantially vertically oriented. The forward lip may form a point of attachment of the cabinet top assembly to the support cabinet.

In some embodiments, a lower plate 13 may be attached to a lower side of the top plate 12 to form a lamination of plates with the lower plate having the lower surface 22. The top 12 and lower 13 plates may be substantially coextensive at the outer perimeter along the sides 26, 27 and the rear 20 of the top plate. The lower plate 13 may also have holes formed therein that may not be coextensive with the mounting apertures. Downturned edge portions of the lower plate 13 may form side reinforcing ribs 15 that extend along the mounting apertures in the top plate, and may generally extend adjacent to the sides 26, 27 of the top plate.

The cabinet top assembly may further include a mounting fixture 30 on the top plate 12 for holding the gaming machine 12 on the top plate, and in turn the support cabinet, when the assembly 10 is mounted on the cabinet. The mounting fixture 30 may be positioned below the top plate 12, and may be mounted on the top plate in a position adjacent to the lower surface 22 of the plate.

The mounting fixture 30 may comprise a first mounting rail 32 that is mounted below the top plate, and may be positioned adjacent to the lower surface of the top plate and may further be mounted on the top plate. The first mounting rail may extend adjacent to the mounting aperture 24 in the top plate, and may comprise a forward mounting rail for the mounting fixture as it is positioned adjacent to the forward mounting aperture. The first mounting rail 32 may have opposite end portions 34, 35 and a central portion 36, with the opposite end portions being located toward the sides of the top plate. A longitudinal axis 37 may extend in a longitudinal direction of the first mounting rail between the end portions 34, 35 and a lateral axis 39 may extend in a lateral direction of the first mounting rail that is oriented perpendicular to the longitudinal axis. In some embodiments, the first mounting rail 32 may be formed by a downturned edge portion of the lower plate 13 positioned toward the front 18 of the top plate 12. The first mounting rail 32 may be unified with the reinforcing ribs 15 by corner 17 unified to the rail 32 and one of the ribs 15.

Illustratively, the first mounting rail 32 may include a trap section 38, and the trap section may be spaced downwardly from the top plate 12 and may extend substantially parallel to the top plate. The trap section 38 may be absent or removed from at least one of the end portions 34, 35 of the first mounting rail for mounting and dismounting the mount member 50 on the rail 32. In some of the most preferred embodiments, the trap section is absent from each of the end portions of the first mounting rail to permit mounting and dismounting of the mount portion at either end portion.

The first mounting rail may further include a support section 40, which may extend upwardly from the trap section toward the top plate. In some embodiments, the support section may extend substantially perpendicular to the lower surface of the top plate. The first mounting rail may include a mount section 42 that may extend from the support section 40 and may be positioned adjacent to the lower surface 22 of the top plate. In some embodiments, the mount section 42 may be oriented substantially parallel to the trap section and substantially perpendicular to the support section. The mount section may also extend from the support section in a substantially opposite direction than the trap section, so that the sections 38, 40, 42 may have a substantially Z-shaped configuration.

The mounting fixture 30 may further comprise a second mounting rail 44 that is mounted below the top plate, and may be positioned adjacent to the lower surface of the top plate. The second mounting rail 44 may be mounted on the top plate, and may extend adjacent to the mounting aperture in the top plate. In some embodiments, the second mounting rail 44 may be formed by a downturned edge portion of the lower plate 13 positioned toward the rear 20 of the top plate 12, and the rail 44 may be unified with the reinforcing ribs 15 by corner 17. The second mounting rail 30 may form a rearward mounting rail as it is positioned adjacent to the rearward mounting aperture. Illustratively, the second mounting rail may be similar or identical to the first mounting rail in configuration, including similar sections, and may have an orientation opposite of the first mounting rail with respect to direction in a horizontal plane. Thus, the trap sections of the first and second mounting rails may extend toward each other.

An intermediate rail 46 may be included in the mounting fixture 30, and may be mounted below the top plate 12, and may extend adjacent to the mounting apertures, and may be positioned between the forward mounting aperture and the rearward mounting aperture. The intermediate rail 46 may be elongated with a longitudinal axis 47 extending in a longitudinal direction of the rail. The intermediate rail 46 may be positioned rearwardly of the first (forward) mounting rail 32, and may be positioned forwardly of the second (rearward) mounting rail. The intermediate rail 46 may be positioned relatively closer to the second mounting rail than the first mounting rail.

The mounting fixture may also comprise at least one support member 48 extending between the first mounting rail 32 and the intermediate rail 46, and a pair of the support members 48, 49 may extend between the first mounting rail and the intermediate rail at locations laterally spaced from each other. Ends of the support member may be fixed to the mounting rail and the intermediate rail to help keep the spacing between the rail 32 and the rail 46 uniform, and thus the support members may be relatively immovable and not removable.

The mounting fixture may comprise at least one mount member 50 that may extend between one of the mounting rails and the intermediate member. In some embodiments, the mount member may be movable to different positions along the rails, and in some embodiments the mount member may be removable from the rails. The mount member 50 may be mounted on one of the mounting rails, and may be slidable along at least a portion of the mounting rail. The mount member may be mounted on the rail so that it is removable from the rail, but may be removable in only some portions of the rail.

The mount member 50 may have a mount end 52 and a free end 54, which may be opposite ends of the elongate mount member. The mount end 52 may be configured to mount on one of the mounting rails and the free end 54 may be configured to abut against the intermediate member when the mount end is mounted on the mounting rail. Located toward the mount end 52 of the mount member may be a mounting slot 56 configured to receive a section of the mounting rail. In greater detail, the mounting slot may be configured to receive the trap section 38 of the mounting rail, and may also be configured to receive the support section 40 of the mounting rail. The mounting slot 56 may have a first extent 58 and a second extent 60, and the first extent may be configured to receive the support section and the second extent may be configured to receive the trap section of the mounting rail. In some embodiments, the second extent 60 may be oriented substantially perpendicular to the first extent to generally correspond to the orientations of the sections of the rail received by the slot 56.

The configuration of the slot, in conjunction with the configuration of the mounting rail sections, tends to securely mount or lock the mount member on the mounting rail particularly in portions of the rail where the trap section is present. The locking or trapping is effected without preventing the sliding movement of the mount member along the mounting rail, thus not significantly restricting the positionability of the mount member for adjustment to correspond to the location of the mounting holes on the gaming machine. In portions of the mounting rail where the trap section is removed or absent, such as the ends portion or portions, the mount member is not locked and can be removed easily. The end portions of the mounting rail may correspond to locations on the mounting fixture where the mounting holes of the gaming machine are unlikely to be located so there is no need to locate the mount members in these locations for the purpose of mounting the gaming machine.

The free end 54 of the mount member may be configured with a notch 62 into which a portion of the intermediate rail 46 may be positioned when the mounting member is mounted on one of the mounting rails. The mount member may not be attached or connected to the intermediate member by the notch, although the notch may provide a locating function for the mount member when the mount member is fastened to the gaming machine and the tightening of the fasteners tends to pull the mount member upwardly toward the machine and into abutment with the intermediate member.

In some embodiments, the mount member may be configured with a lower wall 64 and a pair of spaced side walls 66, 67 extending from the lower wall to form a channel shape, and the mounting slot and notch may be formed in both of the spaced side walls to resist rotation of the mount member in a horizontal plane. The side walls 66, 67 may be substantially parallel to each other and being oriented substantially perpendicular to the lower wall. At least one, and typically a plurality of, fastener slots 68 may be formed on the mount member for receiving a fastener connected to a mounting hole in the gaming machine. The fastener slots may be formed in the lower wall, and two rows of the slots with overlapping side by side configurations may be employed to provide the greatest degree of mounting versatility.

In some embodiments, the trap section 38 of the mounting rails 32, 44 may have one or more slits 70 formed therein at a few locations along the respective rails 32, 44 to permit the tongue 72 of the side walls 66, 67 of the mount member to pass through those locations of the rail. The slits may be spaced from each other at a distance suitable for the tongues of both side walls 66, 67 to pass through the slits simultaneously to mount the mount member on the rail, and then the mount member may be displaced along the rail to lock the mount member to the rail. The slits may be of relatively narrow size so that a mounting member 50 is only removable from a rail at a single location along the rail.

Optionally, the cabinet top assembly 10 may include a plurality of mount posts 74 that extend downwardly from the plates 12, 13 for insertion into bores formed in the upper portions of the support cabinet 2. In some of the more preferred embodiments, the posts each have a head or flange for mounting the post to the plates and the flange may be positioned between the top 12 and lower 13 plates so that the flange does not protrude through the top plate and is covered by the top plate.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A cabinet top assembly for supporting a gaming machine on a support cabinet, the cabinet top assembly comprising:

a top plate for resting the gaming machine thereon, the top plate having an upper surface, a lower surface, a front and a rear, the top plate having at least one mounting aperture therethrough; and a mounting fixture for mounting the gaming machine to the top plate, the mounting fixture being mounted on the top plate adjacent to the lower surface, the mounting fixture comprising:

a first mounting rail positioned below the top plate and extending adjacent to the at least one mounting aperture in the top plate, the first mounting rail being elongated along a longitudinal axis of the first mounting rail, the first mounting rail having a lateral axis oriented substantially perpendicular to the longitudinal axis of the first mounting rail;

an intermediate rail positioned below the top plate and extending adjacent to the at least one mounting aperture opposite of the first mounting rail, the intermediate rail being elongated along a longitudinal axis of the intermediate rail, the intermediate rail having a lateral axis oriented substantially perpendicular to the longitudinal axis of the intermediate rail;

at least one mount member extendable between the first mounting rail and the intermediate rail in a position adjacent to the at least one mounting aperture, the at least one mount member having a mount end and a free end;

wherein the mount end of the at least one mount member has a first structure being configured to mount on the first mounting rail in a manner trapping the mount end on the first mounting rail to thereby resist removal of the mount end from the first mounting rail along the lateral axis of the first mounting rail while permitting sliding of the at least one mount member on the first mounting rail along the longitudinal axis of the first mounting rail; and wherein the free end of the at least one mount member has a second structure configured to permit the free end to abut against the intermediate rail without directly attaching the free end to the intermediate rail in a manner trapping the free end on the intermediate rail to resist removal of the free end from the intermediate rail along the lateral axis of the intermediate rail when the first structure of the mount end of the at least one mount member is mounted on the first mounting rail.

2. The cabinet top assembly of claim 1 wherein the first structure of the mount end of the at least one mount member has a mounting slot configured to slidably receive a section of the first mounting rail.

3. The cabinet top assembly of claim 2 wherein the mounting slot of the first structure of the mount end of the at least one mount member is convoluted to resist removal of the section of the first mounting rail from the mounting slot along the lateral axis of the first mounting rail.

4. The cabinet top assembly of claim 3 wherein the first mounting rail comprises a trap section extending substantially parallel to the top plate and a support section extending upwardly from the trap section in a generally perpendicular orientation to the lower surface of the top plate; and wherein the mounting slot is configured to receive the trap section and at least a portion of the support section of the first mounting rail.

5. The cabinet top assembly of claim 1 wherein the second structure of the free end of the at least one mount member is configured with a notch, the notch resting against a portion of the intermediate rail when the at least one mount member is mounted on the first mounting rail.

6. The cabinet top assembly of claim 1 wherein at least one fastener slot is formed on the at least one mount member for receiving a fastener connected to the gaming machine.

7. The cabinet top assembly of claim 1 additionally comprising a second mounting rail positioned below the top plate and extending adjacent to the at least one mounting aperture in the top plate, the intermediate rail being positioned between the first and second mounting rails.

8. The cabinet top assembly of claim 7 wherein the second mounting rail comprises a trap section extending substantially parallel to the top plate and a support section extending upwardly from the trap section in a generally perpendicular orientation to the lower surface of the top plate.

9. The cabinet top assembly of claim 1 wherein the first mounting rail is formed by portions of a lower plate at least partially laminated to the top plate.

10. The cabinet top assembly of claim 1 wherein the mounting fixture additionally comprises a second mounting rail, and the first and second mounting rails are formed by portions of a lower plate at least partially laminated to the top plate.

11. The cabinet top assembly of claim 1 wherein the intermediate rail and the top plate collectively form a tubular closed perimeter when viewed in a cross section plane oriented perpendicular to the longitudinal axis of the intermediate rail.

12. A cabinet top assembly for supporting a gaming machine on a support cabinet, the cabinet top assembly comprising:

a top plate for resting the gaming machine thereon, the top plate having an upper surface, a lower surface, a front and a rear, the top plate having at least one mounting aperture therethrough; and a mounting fixture for mounting the gaming machine to the top plate, the mounting fixture being mounted on the top plate adjacent to the lower surface, the mounting fixture comprising:

a first mounting rail positioned below the top plate and extending adjacent to the at least one mounting aperture in the top plate, the first mounting rail being elongated along a longitudinal axis of the first mounting rail, the first mounting rail having a lateral axis oriented substantially perpendicular to the longitudinal axis of the first mounting rail;

a second mounting rail positioned below the top plate and extending adjacent to the at least one mounting aperture in the top plate, the second mounting rail being elongated along a longitudinal axis of the second mounting rail, the second mounting rail having a lateral axis oriented substantially perpendicular to the longitudinal axis of the second mounting rail;

an intermediate rail positioned below the top plate and extending adjacent to the at least one mounting aperture, the intermediate rail being positioned between the first and second mounting rails, the intermediate rail being elongated along a longitudinal axis of the intermediate rail, the intermediate rail having a lateral axis oriented substantially perpendicular to the longitudinal axis of the intermediate rail;

a plurality of mount members extendable between the intermediate rail and one of the first and second mounting rails in a position adjacent to the at least one mounting aperture, at least one mount member of the plurality of mount members having a mount end and a free end;

wherein the mount end of the at least one mount member has a first structure being configured to mount on the one of the first and second mounting rails in a manner trapping the mount end on the one of the first and second mounting rails to thereby resist removal of the mount end from the one of the first and second mounting rails along the lateral axis of the one of the first and second mounting rails while permitting sliding of the at least one mount member on the one of the first and second mounting rails along the longitudinal axis of the one of the first and second mounting rails; and wherein the free end of the at least one mount member has a second structure configured to permit the free end to abut against the intermediate rail without directly attaching the free end to the intermediate rail in a manner trapping the free end on the intermediate rail to resist removal of the free end from the intermediate rail along the lateral axis of the intermediate rail when the first structure of the mount end of the at least one mount member is mounted on the one of the first and second mounting rails and the mount end is thereby trapped on the one of the first and second mounting rails.

13. The cabinet top assembly of claim 12 wherein the first structure of the mount end of the at least one mount member of the plurality of mount members has a mounting slot configured to slidably receive a section of the first mounting rail.

14. The cabinet top assembly of claim 13 wherein the mounting slot of the first structure of the mount end of the at least one mount member is convoluted to resist removal of the section of the first mounting rail from the mounting slot.

15. The cabinet top assembly of claim 14 wherein the first mounting rail comprises a trap section extending substantially parallel to the top plate and a support section extending upwardly from the trap section in a generally perpendicular orientation to the lower surface of the top plate; and wherein the mounting slot is configured to receive the trap section and at least a portion of the support section of the first mounting rail.

16. The cabinet top assembly of claim 12 wherein the second structure of the free end of the at least one mount member of the plurality of mount members is configured with a notch, the notch resting against a portion of the intermediate rail when the at least one mount member of the plurality of mount members is mounted on the one of the first and second mounting rails.

17. The cabinet top assembly of claim 12 wherein the intermediate rail and the top plate collectively form a tubular closed perimeter when viewed in a cross section plane oriented perpendicular to the longitudinal axis of the intermediate rail.

18. A gaming system comprising:

a support cabinet;

a cabinet top assembly mounted on a top of the support cabinet; and a gaming machine mounted on the cabinet top assembly;

wherein the cabinet top assembly comprises:

a top plate with a lower surface and an upper surface, the gaming machine resting on the upper surface, the top plate having at least one mounting aperture therethrough, the gaming machine being positioned over the at least one mounting aperture; and a mounting fixture mounting the gaming machine to the top plate, the mounting fixture being mounted on the top plate adjacent to the lower surface, the mounting fixture comprising:

a first mounting rail positioned below the top plate and extending adjacent to the at least one mounting aperture in the top plate, the first mounting rail being elongated along a longitudinal axis of the first mounting rail, the first mounting rail having a lateral axis oriented substantially perpendicular to the longitudinal axis of the first mounting rail;

a second mounting rail positioned below the top plate and extending adjacent to the at least one mounting aperture in the top plate, the second mounting rail being elongated along a longitudinal axis of the second mounting rail, the second mounting rail having a lateral axis oriented substantially perpendicular to the longitudinal axis of the second mounting rail;

an intermediate rail positioned below the top plate and extending adjacent to the at least one mounting aperture, the intermediate rail being positioned between the first and second mounting rails, the intermediate rail being elongated along a longitudinal axis of the intermediate rail, the intermediate rail having a lateral axis oriented substantially perpendicular to the longitudinal axis of the intermediate rail, the intermediate rail and the top plate collectively forming a tubular closed perimeter when viewed in a cross section plane oriented perpendicular to the longitudinal axis of the intermediate rail;

a plurality of mount members extendable between one of the first and second mounting rails and the intermediate rail in a position adjacent to the at least one mounting aperture, at least one mount member of the plurality of mount members having a fastener slot formed therein, a fastener passing through the fastener slot and engaging the gaming machine to attach the at least one mount member to the gaming machine, the at least one mount member having a mount end and a free end;

wherein the mount end of the at least one mount member is configured to mount on the one of the first and second mounting rails with a first structure defining a convoluted slot receiving a portion of the one of the first and second mounting rails in a manner trapping the mount end on the one of the first and second mounting rails to thereby resist removal of the mount end from the one of the first and second mounting rails while permitting sliding of the at least one mount member on the one of the first and second mounting rails along the longitudinal axis of the one of the first and second mounting rails; and wherein the free end of the at least one mount member is configured to abut against the intermediate rail with a second structure defining a notch resting against the intermediate rail without directly attaching the free end to the intermediate rail in a manner trapping the free end on the intermediate rail to thereby resist removal of the free end from the intermediate rail along the lateral axis of the intermediate rail when the first structure of the mount end of the at least one mount member is mounted on the one of the first and second mounting rails.

* * * * *